US006794640B2

(12) United States Patent
Bateman et al.

(10) Patent No.: US 6,794,640 B2
(45) Date of Patent: Sep. 21, 2004

(54) MASS SPECTROMETER

(75) Inventors: Robert Harold Bateman, Knutsford (GB); Jeff Brown, Hyde (GB); Anthony James Gilbert, High Peak (GB)

(73) Assignee: Micromass UK Limited, Manchester (GB)

( * ) Notice: Subject to any disclaimer, the term of this patent is extended or adjusted under 35 U.S.C. 154(b) by 0 days.

(21) Appl. No.: 10/301,710

(22) Filed: Nov. 22, 2002

(65) Prior Publication Data

US 2003/0132377 A1 Jul. 17, 2003

Related U.S. Application Data

(60) Provisional application No. 60/422,092, filed on Oct. 30, 2002.

(30) Foreign Application Priority Data

| | | |
|---|---|---|
| Nov. 22, 2001 | (GB) | 0128017 |
| Dec. 18, 2001 | (GB) | 0130229 |
| May 30, 2002 | (GB) | 0212514 |

(51) Int. Cl.[7] ..... H01J 49/00

(52) U.S. Cl. ..... 250/281; 250/282; 250/292; 250/286; 250/288

(58) Field of Search ..... 250/281, 287, 250/282, 292, 286, 288, 296

(56) References Cited

U.S. PATENT DOCUMENTS

| | | | | |
|---|---|---|---|---|
| 6,011,259 | A * | 1/2000 | Whitehouse et al. | 250/287 |
| 6,020,586 | A | 2/2000 | Dresch et al. | |
| 6,285,027 | B1 * | 9/2001 | Chernushevich et al. | 250/287 |
| 6,504,148 | B1 | 1/2003 | Hager | |
| 6,507,019 | B2 | 1/2003 | Chernushevich et al. | |
| 6,545,268 | B1 | 4/2003 | Verentchikov et al. | |
| 2002/0030159 | A1 | 3/2002 | Chernushevich et al. | |
| 2002/0092980 | A1 | 7/2002 | Park | |
| 2003/0006370 | A1 | 1/2003 | Bateman et al. | |
| 2003/0066958 | A1 | 4/2003 | Okumura et al. | |
| 2003/0141447 | A1 | 7/2003 | Verentchikov et al. | |

FOREIGN PATENT DOCUMENTS

| | | |
|---|---|---|
| EP | 1 051 731 B1 | 7/2002 |
| EP | 1302973 A2 | 4/2003 |
| JP | 2001 297730 | 10/2001 |
| WO | WO 98/06481 | 2/1998 |
| WO | WO 00/33350 | 6/2000 |
| WO | WO 01/15201 | 3/2001 |
| WO | WO 02/48699 | 6/2002 |
| WO | WO 02/078046 | 10/2002 |

OTHER PUBLICATIONS

A. Okumura et al "Mass Spectrometer and Measurement System Using the Mass Spectrometer", Pub. No: US 2003/0066958 A1, Apr. 10, 2003.*

Gabryelski et al., "Photoinduced Dissociation of Electrospray–Generated Ions in an Ion Trap/Time–Of–Flight Mass Spectrometer Using a Pulsed $CO_2$ Laser", Rapid Communications in Mass Spectrometry, pp. 1805–1811, 2002.

Michael et al., "Instrumental Performance of a Quadrupole Ion Trap Storage/Reflectron Time–Of–Flight Mass Spectrometer With MALDI and Electrospray Ionization", 42$^{nd}$ Annual ASMS Conference on Mass Spectrometry, pp. 497, 1994.

Chien et al., "The Design and Performance of an Ion Trap Storage–Reflectron Time–Of–Flight Mass Spectrometer", International Journal of Mass Spectrometry and Ion Processes, vol. 131, No. 1/3, pp. 149–179, 1994.

Wilhelm et al., "Ion Storage Combined With Reflectron Time–Of–Flight Mass Spectrometry: Ion Cloud Motions as a Result of Jet–Cooled Molecules",International Journal of Mass Spectrometry and Ion Processes, vol. 152, No. 2, pp. 111–129, 1996.

* cited by examiner

*Primary Examiner*—John R. Lee
*Assistant Examiner*—Zia R. Hashmi
(74) *Attorney, Agent, or Firm*—Diederiks & Whitelaw, PLC

(57) ABSTRACT

A mass spectrometer is disclosed comprising a mass selective ion trap such as a 3D quadrupole field ion trap upstream of a pusher electrode of an orthogonal acceleration Time of Flight mass analyzer. According to a first embodiment bunches of ions are released from the ion trap and the pusher electrode is energised after a delay time which is progressively varied. According to a second embodiment ions are released from the ion trap in reverse order of mass to charge ratio with the ions having the largest mass to charge ratio being released first. By appropriate release of the ions from the ion trap it is possible to ensure that substantially all of the ions arrive at the pusher electrode at substantially the same time. According to both embodiments it is possible to achieve a duty cycle approaching 100% across a large range of mass to charge ratios.

43 Claims, 5 Drawing Sheets

MASS SPECTROMETER

CROSS-REFERENCE TO RELATED APPLICATIONS

This application claims the benefit of the filing date of U.S. Provisional Application Serial No. 60/422,092 filed Oct. 30, 2002.

BACKGROUND OF THE INVENTION

1. Field of the Invention

The present invention relates to a mass spectrometer.

2. Discussion of the Prior Art

The duty cycle of an orthogonal acceleration Time of Flight ("oaTOF") mass analyser is typically in the region of 20–30% for ions of the maximum mass to charge ratio and less for ions with lower mass to charge ratios.

FIG. 1 illustrates part of the geometry of a conventional orthogonal acceleration Time of Flight mass analyser. In an orthogonal acceleration Time of Flight mass analyser ions are orthogonally accelerated into a drift region (not shown) by a pusher electrode 1 having a length L1. The distance between the pusher electrode 1 and the ion detector 2 may be defined as being L2. The time taken for ions to pass through the drift region, be reflected by a reflectron (not shown) and reach the ion detector 2 is the same as the time it would have taken for the ions to have travelled the axial distance L1+L2 from the centre of the pusher electrode 1 to the centre of the ion detector 2 had the ions not been accelerated into the drift region. The length of the ion detector 2 is normally at least L1 so as to eliminate losses.

If the Time of Flight mass analyser is designed to orthogonally accelerate ions having a maximum mass to charge ratio $M_{max}$ then the cycle time $\Delta T$ between consecutive energisations of the pusher electrode 1 (and hence pulses of ions into the drift region) is the time required for ions of mass to charge ratio equal to $M_{max}$ to travel the axial distance L1+L2 from the pusher electrode 1 to the ion detector 2.

The duty cycle $D_{cy}$ for ions with a mass to charge ratio M is given by:

$$D_{cy} = \frac{L1}{L1 + L2} \cdot \sqrt{\frac{M}{M_{\max}}}$$

For example, if L1 is 35 mm and the distance L2 is 90 mm then the duty cycle for ions of maximum mass to charge value is given by L1/(L1+L2) which equals 28.0%.

Increasing L1 and/or decreasing L2 will in theory increase the duty cycle. However, increasing L1 would require a larger and hence more expensive ion detector 2 and this would also place a greater demand on mechanical alignment including grid flatness. Such an option is not therefore practical.

On the other hand, reducing L2 would also be impractical. Reducing L2 per se would shorten the flight time in the drift region and result in a loss of resolution. Alternatively, L2 could be reduced and the flight time kept constant by reducing the energy of the ions prior to them reaching the pusher electrode 1. However, this would result in ions which were less confined and there would be a resulting loss in transmission.

A person skilled in the art will therefore appreciate that for mechanical and physical reasons constraints are placed on the values that L1 and L2 can take, and this results in a typical maximum duty cycle in the range 20–30%.

It is known to trap and store ions upstream of the pusher electrode 1 in an ion trap which is non-mass selective i.e. the ion trap does not discriminate on the basis of mass to charge ratio but either traps all ions or releases all ions (by contrast a mass selective ion trap can release just some ions having specific mass to charge ratios whilst retaining others). All the ions trapped within the ion trap are therefore released in a packet or pulse of ions. Ions with different mass to charge values travel with different velocities to the pusher electrode 1 so that only certain ions are present adjacent the pusher electrode 1 when the pusher electrode 1 is energised so as to orthogonally accelerate ions into the drift region. Some ions will still be upstream of the pusher electrode 1 when the pusher electrode 1 is energised and other others will have already passed the pusher electrode 1 when the pusher electrode 1 is energised. Accordingly, only some of the ions released from the upstream ion trap will actually be orthogonally accelerated into the drift region of the Time of Flight mass analyser.

By arranging for the pusher electrode 1 to orthogonally accelerate ions a predetermined time after ions have been released from the ion trap it is possible to increase the duty cycle for some ions having a certain mass to charge ratio to approximately 100%. However, the duty cycle for ions having other mass to charge ratios may be much less than 100% and for a wide range of mass to charge ratios the duty cycle will be 0%.

The dashed line in FIG. 2 illustrates the duty cycle for an orthogonal acceleration Time of Flight mass analyser operated in a conventional manner without an upstream ion trap. The maximum mass to charge ratio is assume to be 1000, L1 was set to 35 mm and the distance L2 was set to 90 mm. The maximum duty cycle is 28% for ions of mass to charge ratio 1000 and for lower mass to charge ratio ions the duty cycle is much less.

The solid line in FIG. 2 illustrates how the duty cycle for some ions may be enhanced to approximately 100% when a non-mass selective upstream ion trap is used. In this case it is assumed that the distance from the ion trap to the pusher electrode 1 is 165 mm and that the pusher electrode 1 is arranged to be energised at a time after ions are released from the upstream ion trap such that ions having a mass to charge ratio of 300 are orthogonally accelerated with a resultant duty cycle of 100%. However, as is readily apparent from FIG. 2, the duty cycle for ions having smaller or larger mass to charge ratios decreases rapidly so that for ions having a mass to charge ratio $\leqq 200$ and for ions having a mass to charge ratio $\geqq 450$ the duty cycle is 0%. The known method of increasing the duty cycle for just some ions may be of interest if only a certain part of the mass spectrum is of interest such as for precursor ion discovery by the method of daughter ion scanning. However, it is of marginal or no benefit if a full mass spectrum is required.

It is therefore desired to provide a mass spectrometer which overcomes at least some of the disadvantages of the known arrangements.

SUMMARY OF THE INVENTION

According to an aspect of the present invention there is provided a mass spectrometer comprising: a mass selective ion trap; an orthogonal acceleration Time of Flight mass analyser arranged downstream of the ion trap, the orthogonal acceleration Time of Flight mass analyser comprising an electrode for orthogonally accelerating ions; and a control means for controlling the mass selective ion trap and the orthogonal acceleration Time of Flight mass analyser, wherein in a mode of operation the control means controls the ion trap and the orthogonal acceleration Time of Flight mass analyser so that: (i) at a first time $t_1$ ions having mass to charge ratios within a first range are arranged to be substantially passed from the ion trap to the orthogonal acceleration Time of Flight mass analyser whilst ions having mass to charge ratios outside of the first range are not substantially passed to the orthogonal acceleration Time of Flight mass analyser; (ii) at a later time $t_1+\Delta t_1$ the electrode is arranged to orthogonally accelerate ions having mass to charge ratios within the first range; (iii) at a second later time $t_2$ ions having mass to charge ratios within a second range are arranged to be substantially passed from the ion trap to the orthogonal acceleration Time of Flight mass analyser whilst ions having mass to charge ratios outside of the second range are not substantially passed to the orthogonal acceleration Time of Flight mass analyser; and (iv) at a later time $t_2+\Delta t_2$ the electrode is arranged to orthogonally accelerate ions having mass to charge ratios within the second range, wherein $\Delta t_1 \neq \Delta t_2$. Accordingly, ions are released from the ion trap and are orthogonally accelerated after a first delay and then further ions are released from the ion trap and are orthogonally accelerated after a second different delay time.

At the first time $t_1$ ions having mass to charge ratios outside of the first range are preferably substantially retained within the ion trap. Likewise, at the second time $t_2$ ions having mass to charge ratios outside of the second range are preferably substantially retained within the ion trap.

The first range preferably has a minimum mass to charge ratio $M1_{min}$ and a maximum mass to charge ratio $M1_{max}$ and wherein the value $M1_{max}-M1_{min}$ falls within a range of 1–50, 50–100, 100–200, 200–300, 300–400, 400–500, 500–600, 600–700, 700–800, 800–900, 900–1000, 1000–1100, 1100–1200, 1200–1300, 1300–1400, 1400–1500 or >1500.

Similarly, the second range preferably has a minimum mass to charge ratio $M2_{min}$ and a maximum mass to charge ratio $M2_{max}$ and wherein the value $M2_{max}-M2_{min}$ falls within a range of 1–50, 50–100, 100–200, 200–300, 300–400, 400–500, 500–600, 600–700, 700–800, 800–900, 900–1000, 1000–1100, 1100–1200, 1200–1300, 1300–1400, 1400–1500 or >1500.

The control means preferably further controls the ion trap and the orthogonal acceleration Time of Flight mass analyser so that: (v) at a third later time $t_3$ ions having mass to charge ratios within a third range are arranged to be substantially passed from the ion trap to the orthogonal acceleration Time of Flight mass analyser whilst ions having mass to charge ratios outside of the third range are not substantially passed to the orthogonal acceleration Time of Flight mass analyser; and (vi) at a later time $t_3+\Delta t_3$ the electrode is arranged to orthogonally accelerate ions having mass to charge ratios within the third range, wherein $\Delta t_1 \neq \Delta t_2 \neq \Delta t_3$.

At the third time $t_3$ ions having mass to charge ratios outside of the third range are preferably substantially retained within the ion trap.

The third range preferably has a minimum mass to charge ratio $M3_{min}$ and a maximum mass to charge ratio $M3_{max}$ and wherein the value $M3_{max}-M3_{min}$ falls within a range of 1–50, 50–100, 100–200, 200–300, 300–400, 400–500, 500–600, 600–700, 700–800, 800–900, 900–1000, 1000–1100, 1100–1200, 1200–1300, 1300–1400, 1400–1500 or >1500.

The control means preferably further controls the ion trap and the orthogonal acceleration Time of Flight mass analyser so that: (vii) at a fourth later time $t_4$ ions having mass to charge ratios within a fourth range are arranged to be substantially passed from the ion trap to the orthogonal acceleration Time of Flight mass analyser whilst ions having mass to charge ratios outside of the fourth range are not substantially passed to the orthogonal acceleration Time of Flight mass analyser; and (viii) at a later time $t_4+\Delta t_4$ the electrode is arranged to orthogonally accelerate ions having mass to charge ratios within the fourth range, wherein $\Delta t_1 \neq \Delta t_2 \neq \Delta t_3 \neq \Delta t_4$.

At the fourth time $t_4$ ions having mass to charge ratios outside of the fourth range are preferably substantially retained within the ion trap.

The fourth range preferably has a minimum mass to charge ratio $M4_{min}$ and a maximum mass to charge ratio $M4_{max}$ and wherein the value $M4_{max}-M4_{min}$ falls within a range of 1–50, 50–100, 100–200, 200–300, 300–400, 400–500, 500–600, 600–700, 700–800, 800–900, 900–1000, 1000–1100, 1100–1200, 1200–1300, 1300–1400, 1400–1500 or >1500. According to various embodiments at least five, six, seven, eight, nine, ten or more bunches of ions may be consecutively released from the ion trap and orthogonally accelerated after a delay time which preferably varies in each case.

The mass selective ion trap may be either a 3D quadrupole field ion trap, a magnetic ("Penning") ion trap or a linear quadrupole ion trap.

The ion trap may comprise in use a gas so that ions enter the ion trap with energies such that the ions are collisionally cooled without substantially fragmenting upon colliding with the gas. Alternatively, ions may be arranged to enter the ion trap with energies such that at least 10% of the ions are caused to fragment upon colliding with the gas i.e. the ion trap also acts as a collision cell.

Ions may be released from the mass selective ion trap by mass-selective instability and/or by resonance ejection. If mass-selective instability is used to eject ions from the ion trap then the ion trap is either in a low pass mode or in a high pass mode. As such, $M1_{max}$ and/or $M2_{max}$ and/or $M3_{max}$ and/or $M4_{max}$ may in a high pass mode be at infinity. Likewise, in a low pass mode $M1_{min}$ and/or $M2_{min}$ and/or $M3_{min}$ and/or $M4_{min}$ may be zero. If resonance ejection is used to eject ions from the ion trap then the ion trap may be operated in either a low pass mode, high pass mode or bandpass mode. Other modes of operation are also possible.

The orthogonal acceleration Time of Flight mass analyser preferably comprises a drift region and an ion detector, wherein the electrode is arranged to orthogonally accelerate ions into the drift region. The mass spectrometer may further comprise an ion source, a quadrupole mass filter and a gas collision cell for collision induced fragmentation of ions.

According to an embodiment the mass spectrometer may comprise a continuous ion source such as an Electrospray ion source, an Atmospheric Pressure Chemical Ionisation ("APCI") ion source, an Electron Impact ("EI") ion source, an Atmospheric Pressure Photon Ionisation ("APPI") ion source, a Chemical Ionisation ("CI") ion source, a Fast Atom Bombardment ("FAB") ion source, a Liquid Secondary Ions Mass Spectrometry ("LSIMS") ion source, an Inductively Coupled Plasma ("ICP") ion source, a Field Ionisation ("FI") ion source, and a Field Desorption ("FD") ion source.

For operation with a continuous ion source a further ion trap may be provided which continuously acquires ions from the ion source and traps them before releasing bunches of ions for storage in the mass selective ion trap. The further ion trap may comprise a linear RF multipole ion trap or a linear RF ring set (ion tunnel) ion trap. A linear RF ring set (ion tunnel) is preferred since it may have a series of programmable axial fields. The ion tunnel ion guide can act therefore not only as an ion guide but the ion tunnel ion guide can move ions along its length and retain or store ions at certain positions along its length. Hence, in the presence of a bath gas for collisional damping the ion tunnel ion guide can continuously receive ions from a ion source and store them at an appropriate position near the exit. If required it can also be used for collision induced fragmentation of those ions. It can then be programmed to periodically release ions for collection and storage in the ion trap.

Between each release of ions the mass selective ion trap may receive a packet of ions from the further ion trap. The trapping of ions in the ion trap may also be aided by the presence of a background gas or bath gas for collisional cooling of the ions. This helps quench their motion and improves trapping. In this way the mass selective ion trap may be periodically replenished with ions ready for release to the orthogonal acceleration Time of Flight mass analyser.

An arrangement incorporating two traps enables a high duty cycle to be obtained for all ions irrespective of their mass to charge value. A tandem quadrupole Time of Flight mass spectrometer may be provided comprising an ion source, an ion guide, a quadrupole mass filter, a gas collision cell for collision induced fragmentation, an 3D quadrupole ion trap, a further ion guide, and an orthogonal acceleration Time of Flight mass analyser. It will be apparent that the duty cycle will be increased compared with conventional arrangements irrespective of whether the mass spectrometer is operated in the MS (non-fragmentation) mode or MS/MS (fragmentation) mode.

According to another embodiment the mass spectrometer may comprise a pseudo-continuous ion source such as a Matrix Assisted Laser Desorption Ionisation ("MALDI") ion source and a drift tube or drift region arranged so that ions become dispersed. The drift tube or drift region may also be provided with gas to collisionally cool ions.

According to another embodiment the mass spectrometer may comprise a pulsed ion source such as a Matrix Assisted Laser Desorption Ionisation ("MALDI") ion source or a Laser Desorption Ionisation ion source.

Although a further ion trap is preferably provided upstream of the mass selective ion trap when a continuous ion source is provided, a further ion trap may be provided irrespective of the type of ion source being used. In a mode of operation the axial electric field along the further ion trap may be varied either temporally and/or spatially. In a mode of operation ions may be urged along the further ion trap by an axial electric field which varies along the length of the further ion trap. In a mode of operation at least a portion of the further ion trap may act as an AC or RF-only ion guide with a constant axial electric field. In a mode of operation at least a portion of the further ion trap may retain or store ions within one or more locations along the length of the further ion trap.

According to a particularly preferred embodiment the further ion trap may comprise an AC or RF ion tunnel ion trap comprising at least 4 electrodes having similar sized apertures through which ions are transmitted in use. The ion trap may comprise at least 4, 5, 6, 7, 8, 9, 10, 15, 20, 25, 30, 35, 40, 45, 50, 55, 60, 65, 70, 75, 80, 85, 90, 95 or 100 such electrodes according to other embodiments.

According to less preferred embodiments the further ion trap may comprise a linear quadrupole ion trap, a linear hexapole, octopole or higher order multipole ion trap, a 3D quadrupole field ion trap or a magnetic ("Penning") ion trap. The further ion trap may or may not therefore be mass selective itself.

The further ion trap preferably substantially continuously receives ions at one end.

The further ion trap may comprise in use a gas so that ions are arranged to either enter the further ion trap with energies such that the ions are collisionally cooled without substantially fragmenting upon colliding with the gas. Alternatively, ions may be arranged to enter the further ion trap with energies such that at least 10% of the ions are caused to fragment upon colliding with the gas i.e. the further ion trap acts as a collision cell.

The further ion trap preferably periodically releases ions and passes at least some of the ions to the mass selective ion trap.

According to another aspect of the present invention, there is provided a mass spectrometer comprising: a 3D quadrupole ion trap; an orthogonal acceleration Time of Flight mass analyser arranged downstream of the 3D quadrupole ion trap, the orthogonal acceleration Time of Flight mass analyser comprising an electrode for orthogonally accelerating ions; and control means for controlling the ion trap and the electrode, wherein the control means causes: (i) a first packet of ions having mass to charge ratios within a first range to be released from the ion trap and then the electrode to orthogonally accelerate the first packet of ions after a first delay time; and (ii) a second packet of ions having mass to charge ratios within a second (different) range to be released from the ion trap and then the electrode to orthogonally accelerate the second packet of ions after a second (different) delay time.

The control means preferably further causes: (iii) a third packet of ions having mass to charge ratios within a third (different) range to be released from the ion trap and then the electrode to orthogonally accelerate the third packet of ions after a third (different) delay time; and (iv) a fourth packet of ions having mass to charge ratios within a fourth (different) range to be released from the ion trap and then the electrode to orthogonally accelerate the fourth packet of ions after a fourth (different) delay time.

The first, second, third and fourth ranges are preferably all different and the first, second, third and fourth delay times are preferably all different. Preferably, at least the upper mass cut-off and/or the lower mass cut-off of the first, second, third and fourth ranges are different. The width of the first, second, third and fourth ranges may or may not be the same. According to other embodiments at least 5, 6, 7, 8, 9, 10 or more than 10 packets of ions may be released and orthogonally accelerated.

According to another aspect of the present invention there is provided a method of mass spectrometry comprising: ejecting ions having mass to charge ratios within a first range from a mass selective ion trap whilst ions having mass to charge ratios outside of the first range are retained within the ion trap; orthogonally accelerating ions having mass to charge ratios within the first range after a first delay time; ejecting ions having mass to charge ratios within a second (different) range from a mass selective ion trap whilst ions having mass to charge ratios outside of the second range are retained within the ion trap; and orthogonally accelerating ions having mass to charge ratios within the second range after a second delay time different from the first delay time.

According to another aspect of the present invention there is provided a mass spectrometer comprising a mass selective ion trap upstream of an electrode for orthogonally accelerating ions, wherein in a mode of operation a first packet of ions is released from the ion trap and the electrode is energised after a first predetermined delay time, a second packet of ions is released from the ion trap and the electrode is energized after a second predetermined delay time, a third packet of ions is released from the ion trap and the electrode is energised after a third predetermined delay time, and a fourth packet of ions is released from the ion trap and the electrode is energised after a fourth predetermined delay time, wherein the first, second, third and fourth delay times are all different.

According to another aspect of the present invention, there is provided a mass spectrometer comprising: a mass selective ion trap; and an orthogonal acceleration Time of Flight mass analyser having an electrode for orthogonally accelerating ions into a drift region; wherein multiple packets of ions are progressively released from the mass selective ion trap and are sequentially or serially ejected into the drift region after different delay times. The ions are progressively released according to their mass to charge ratios i.e. the ions are released in a mass to charge ratio selective manner.

According to another aspect of the present invention, there is provided a method of mass spectrometry comprising: progressively releasing multiple packets of ions from a mass selective ion trap so that the packets of ions are sequentially or serially ejected into a drift region of an orthogonal acceleration Time of Flight mass analyser by an electrode after different delay times. The ions are progressively released according to their mass to charge ratios i.e. the ions are released in a mass to charge ratio selective manner.

According to another aspect of the present invention there is provided a mass spectrometer comprising: a mass selective ion trap; an orthogonal acceleration Time of Flight mass analyser arranged downstream of the ion trap, the orthogonal acceleration Time of Flight mass analyser comprising an electrode for orthogonally accelerating ions; and a control means for controlling the mass selective ion trap and the orthogonal acceleration Time of Flight mass analyser, wherein in a mode of operation the control means controls the ion trap and the orthogonal acceleration Time of Flight mass analyser so that: (i) at a first time $t_1$ ions having mass to charge ratios within a first range are arranged to be substantially passed from the ion trap to the orthogonal acceleration Time of Flight mass analyser whilst ions having mass to charge ratios outside of the first range are not substantially passed to the orthogonal acceleration Time of Flight mass analyser; (ii) at a second later time $t_2$ after $t_1$ ions having mass to charge ratios within a second range are arranged to be substantially passed from the ion trap to the orthogonal acceleration Time of Flight mass analyser whilst ions having mass to charge ratios outside of the second range are not substantially passed to the orthogonal acceleration Time of Flight mass analyser; and (iii) at a later time $t_{push}$ after $t_1$ and $t_2$ the electrode is arranged to orthogonally accelerate ions having mass to charge ratios within the first and second ranges. The electrode is not energised in the time after $t_1$ and prior to $t_{push}$.

According to a preferred embodiment ions are released from the mass selective ion trap in a pulsed manner as a number of discrete packets of ions. However, according to another embodiment the mass selective characteristics of the mass selective ion trap may be continuously varied. Therefore, reference in the claims to ions having mass to charge ratios within a first range being released at a first time $t_1$ and ions having mass to charge ratios within a second range etc. being released at a second etc. time $t_2$ should be construed as covering embodiments wherein the mass selective characteristics of the mass selective ion trap are varied in a stepped manner and embodiments wherein the mass selective characteristics of the mass selective ion trap are varied in a substantially continuous manner. Embodiments are also contemplated wherein the mass selective characteristics of the ion trap may be varied in a stepped manner for a portion of an operating cycle and in a continuous manner for another portion of the operating cycle.

At the first time $t_1$ ions having mass to charge ratios outside of the first range are preferably substantially retained within the ion trap. Likewise, at the second time $t_2$ ions having mass to charge ratios outside of the second range are preferably substantially retained within the ion trap.

The first range preferably has a minimum mass to charge ratio $M1_{min}$ and a maximum mass to charge ratio $M1_{max}$. The value $M1_{max}$–$M1_{min}$ preferably falls within a range of 1–50, 50–100, 100–200, 200–300, 300–400, 400–500, 500–600, 600–700, 700–800, 800–900, 900–1000, 1000–1100, 1100–1200, 1200–1300, 1300–1400, 1400–1500 or >1500.

Similarly, the second range has a minimum mass to charge ratio $M2_{min}$ and a maximum mass to charge ratio $M2_{max}$. The value $M2_{max}$–$M2_{min}$ preferably falls within a range of 1–50, 50–100, 100–200, 200–300, 300–400, 400–500, 500–600, 600–700, 700–800, 800–900, 900–1000, 1000–1100, 1100–1200, 1200–1300, 1300–1400, 1400–1500 or >1500.

Preferably, $M1_{max}>M2_{max}$ and/or $M1_{min}>M2_{min}$ i.e. the upper mass cut-off in the first range is preferably greater than the upper mass cut-off in the second range and/or the lower mass cut-off in the first range is preferably greater than the lower mass cut-off in the second range.

The control means preferably further controls the ion trap and the orthogonal acceleration Time of Flight mass analyser so that: (iv) at a third later time $t_3$ after $t_1$ and $t_2$ but prior to $t_{push}$ ions having mass to charge ratios within a third range are arranged to be substantially passed from the ion trap to the orthogonal acceleration Time of Flight mass analyser whilst ions having mass to charge ratios outside of the third range are not substantially passed to the orthogonal acceleration Time of Flight mass analyser; and wherein at the time $t_{push}$ the electrode is arranged to orthogonally accelerate ions having mass to charge ratios within the first, second and third ranges.

At the third time $t_3$ ions having mass to charge ratios outside of the third range are preferably substantially retained within the ion trap.

The third range preferably has a minimum mass to charge ratio $M3_{min}$ and a maximum mass to charge ratio $M3_{max}$. The value $M3_{max}$–$M3_{min}$ preferably falls within a range of 1–50, 50–100, 100–200, 200–300, 300–400, 400–500, 500–600, 600–700, 700–800, 800–900, 900–1000, 1000–1100, 1100–1200, 1200–1300, 1300–1400, 1400–1500 or >1500.

Preferably, $M2_{max}>M3_{max}$ and/or $M2_{min}>M3_{min}$.

The control means preferably further controls the ion trap and the orthogonal acceleration Time of Flight mass analyser so that: (v) at a fourth later time $t_4$ after $t_1$, $t_2$ and $t_3$ but prior to $t_{push}$ ions having mass to charge ratios within a fourth range are arranged to be substantially passed from the ion trap to the orthogonal acceleration Time of Flight mass analyser whilst ions having mass to charge ratios outside of the fourth range are not substantially passed to the orthogonal acceleration Time of Flight mass analyser; and wherein at the time $t_{push}$ the electrode is arranged to orthogonally accelerate ions having mass to charge ratios within the first, second, third and fourth ranges.

At the fourth time $t_4$ ions having mass to charge ratios outside of the fourth range are preferably substantially retained within the ion trap.

The fourth range preferably has a minimum mass to charge ratio $M4_{min}$ and a maximum mass to charge ratio $M4_{max}$. The value $M4_{max}$–$M4_{min}$ preferably falls within a range of 1–50, 50–100, 100–200, 200–300, 300–400, 400–500, 500–600, 600–700, 700–800, 800–900, 900–1000, 1000–1100, 1100–1200, 1200–1300, 1300–1400, 1400–1500 or >1500.

Preferably, $M3_{max}>M4_{max}$ and/or $M3_{min}>M4_{min}$. The electrode is not energised after time $t_1$ and prior to $t_{push}$.

Ions may be released from the mass selective ion trap by mass-selective instability and/or by resonance ejection. If mass-selective instability is used to eject ions from the ion trap then the ion trap is either in a low pass mode or in a high pass mode. As such, $M1_{max}$ and/or $M2_{max}$ and/or $M3_{max}$ and/or $M4_{max}$ may in a high pass mode be at infinity. Likewise, in a low pass mode $M1_{min}$ and/or $M2_{min}$ and/or $M3_{min}$ and/or $M4_{min}$ may be zero. If resonance ejection is used to eject ions from the ion trap then the ion trap may be operated in either a low pass mode, high pass mode or bandpass mode. Other modes of operation are also possible.

According to another aspect of the present invention there is provided a mass spectrometer comprising; a 3D quadrupole ion trap; an orthogonal acceleration Time of Flight mass analyser arranged downstream of the 3D quadrupole ion trap, the orthogonal acceleration Time of Flight mass analyser comprising an electrode for orthogonally accelerating ions; and control means for controlling the ion trap and the electrode, wherein the control means causes: (i) at a first time $t_1$ a first packet of ions having mass to charge ratios within a first range to be released from the ion trap; and (ii) at a second later time $t_2$ after $t_1$ a second packet of ions having mass to charge ratios within a second (different) range to be released from the ion trap; and then (iii) at a later time $t_{push}$ after $t_1$ and $t_2$ the electrode to orthogonally accelerate the first and second packets of ions. The electrode is not energised after time $t_1$ and prior to $t_{push}$.

Preferably, the control means further causes: (iv) at a time $t_3$ after $t_1$ and $t_2$ but prior to $t_{push}$ a third packet of ions having mass to charge ratios within a third (different) range to be released from the ion trap; and (v) at a time $t_4$ after $t_1$, $t_2$ and $t_3$ but prior to $t_{push}$ a fourth packet of ions having mass to charge ratios within a fourth (different) range to be released from the ion trap.

Preferably, the first, second, third and fourth ranges are all different. Preferably, at least the upper mass cut-off and/or the lower mass cut-off of the first, second, third and fourth ranges are different. The width of the first, second, third and fourth ranges may or may not be the same.

Preferably, the first range has a maximum mass to charge ratio $M1_{max}$, the second range has a maximum mass to charge ratio $M2_{max}$, the third range has a maximum mass to charge ratio $M3_{max}$, the fourth range has a maximum mass to charge ratio $M4_{max}$, and wherein $M1_{max}>M2_{max}>M3_{max}>M4_{max}$. Alternatively, in the case of mass-selective instability $M1_{max}$, $M2_{max}$, $M3_{max}$, $M4_{max}$ etc. may all be at infinity.

Preferably, the first range has a minimum mass to charge ratio $M1_{min}$, the second range has a minimum mass to charge ratio $M2_{min}$, the third range has a minimum mass to charge ratio $M3_{min}$, the fourth range has a minimum mass to charge ratio $M4_{max}$, and wherein $M1_{min}>M2_{min}>M3_{min}>M4_{min}$. Alternatively, in the case of mass-selective instability $M1_{min}$, $M2_{min}$, $M3_{min}$, $M4_{min}$ etc. may all be at zero.

According to another aspect of the present invention, there is provided a method of mass spectrometry comprising: ejecting ions having mass to charge ratios within a first range from a mass selective ion trap whilst ions having mass to charge ratios outside of the first range are retained within the ion trap; then ejecting ions having mass to charge ratios within a second range from the mass selective ion trap whilst ions having mass to charge ratios outside of the second range are retained within the ion trap; and then orthogonally accelerating ions having mass to charge ratios within the first and second ranges, wherein the first and second ranges are different.

According to another aspect of the present invention, there is provided a method of mass spectrometry comprising releasing multiple packets of ions from a mass selective ion trap upstream of an electrode for orthogonally accelerating ions, wherein the multiple packets of ions are arranged to arrive at the electrode at substantially the same time. The ions are released according to their mass to charge ratios i.e. the ions are released in a mass to charge ratio selective manner.

According to another aspect of the present invention, there is provided a mass spectrometer comprising a mass selective ion trap upstream of an electrode for orthogonally accelerating ions, wherein in a mode of operation multiple packets of ions are released from the ion trap so that the multiple packets of ions arrive at the electrode at substantially the same time. The ions are released according to their mass to charge ratios i.e. the ions are released in a mass to charge ratio selective manner.

According to another aspect of the present invention there is provided a method of mass spectrometry comprising substantially continuously releasing ions from a mass selective ion trap upstream of an electrode for orthogonally accelerating ions, wherein the ions are arranged to arrive at the electrode at substantially the same time. The ions are released according to their mass to charge ratios.

According to another aspect of the present invention there is provided a mass spectrometer comprising a mass selective ion trap upstream of an electrode for orthogonally accelerating ions, wherein in a mode of operation ions are substantially continuously released from the ion trap so that the ions arrive at the electrode at substantially the same time.

According to another aspect of the present invention, there is provided a mass spectrometer comprising: a mass selective ion trap; and an orthogonal acceleration Time of Flight mass analyser having an electrode for orthogonally accelerating ions into a drift region; wherein in a first mode of operation multiple packets of ions are progressively released from the mass selective ion trap and are sequentially or serially ejected into the drift region after different delay times and wherein in a second mode of operation multiple packets of ions are released so that the multiple packets of ions arrive at the electrode at substantially the same time.

According to another aspect of the present invention there is provided a method of mass spectrometry comprising; progressively releasing multiple packets of ions from a mass selective ion trap so that the packets of ions are sequentially or serially ejected into a drift region of an orthogonal acceleration Time of Flight mass analyser by an electrode after different delay times; and then releasing multiple packets of ions from the mass selective ion trap so that the multiple packets of ions arrive at the electrode at substantially the same time.

As will be appreciated from above, two distinct main embodiments are contemplated. According to the first main embodiment ions having mass to charge values within a specific range are ejected from a mass selective ion trap such as a 3D quadrupole field ion trap upstream of the pusher electrode. Ions not falling within the specific range of mass to charge values preferably remain trapped within the ion trap.

The ion trap stores ions and can be controlled to eject either only those ions having a specific discrete mass to charge ratio, ions having mass to charge ratios within a specific range (bandpass transmission), ions having a mass to charge ratios greater than a specific value (highpass transmission), ions having a mass to charge ratios smaller than a specific value (lowpass transmission), or ions having mass to charge ratios greater than a specific value together with ions having mass to charge ratios smaller than another specific value (bandpass filtering).

The range of the mass to charge ratios of the ions released from the mass selective ion trap and the delay time thereafter when the pusher electrode orthogonally accelerates the ions in the region of the pusher electrode can be arranged so that preferably nearly all of the ions released from the ion trap are orthogonally accelerated. Therefore, it is possible to achieve a duty cycle of approximately 100% across a large mass range.

Ions which are not released from the ion trap when a first bunch of ions is released are preferably retained in the ion trap and are preferably released in subsequent pulses from the ion trap. For each cycle, ions with a different band or range of mass to charge values are released. Eventually, substantially all of the ions are preferably released from the ion trap. Since substantially all of the ions released from the ion trap are orthogonally accelerated into the drift region of the Time of Flight mass analyser, the duty cycle for ions of all mass to charge values may approach 100%. This represents a significant advance in the art.

According to a second main embodiment of the present invention ions are stored in a mass selective ion trap and are then released, preferably sequentially, in reverse order of mass to charge ratio. Ions with the highest mass to charge ratios are released first and ions with the lowest mass to charge ratios are released last.

Ions with high mass to charge ratios travel more slowly and so by releasing these ions first they have a head start over ions with lower mass to charge ratios. The ions may be accelerated to a constant energy by applying an appropriate voltage to the ion trap and may then be allowed to travel along a field free drift region. By appropriate design of the mass scan law of the 3D quadrupole field ion trap or other mass selective ion trap, ions may be ejected from the ion trap such that all ions irrespective of their mass to charge ratios arrive at the pusher electrode at substantially the same time and with the same energy. This enables the duty cycle for ions of all mass to charge values to be raised to approximately 100% and again represents a significant advance in the art.

Where reference is made in the present application to a mass selective ion trap it should be understood that the ion trap is selective about the mass to charge ratios of the ions released from the ion trap unlike a non-mass selective ion trap wherein when ions are released from the ion trap they are released irrespective of and independent of their mass to charge ratio.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENT

Figure 1:
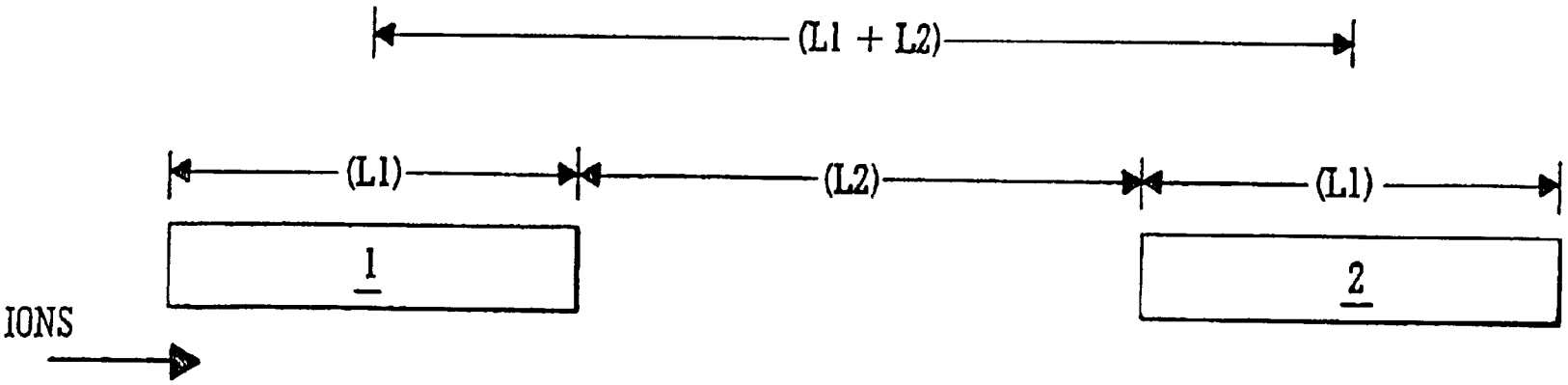
FIG. 1 PRIOR ART
FIG. 1 illustrates part of the geometry of a conventional orthogonal acceleration Time of Flight mass analyser.
Figure 2:
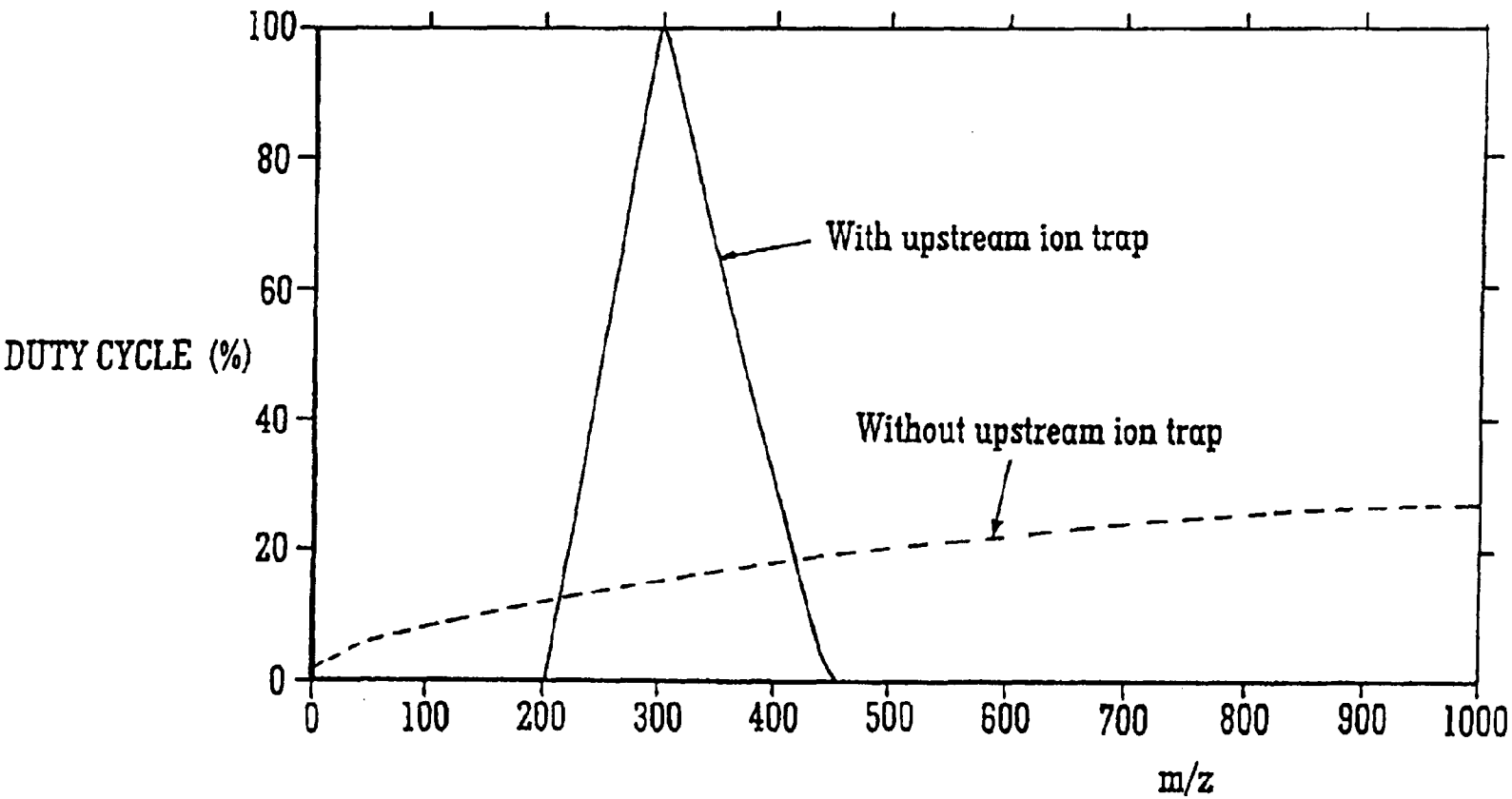
FIG. 2 PRIOR ART
FIG. 2 illustrates how the duty cycle varies with mass to charge ratio for a conventional arrangement without an upstream ion trap and for a known arrangement having a non-mass selective upstream ion trap.

A first main embodiment of the present invention comprises a mass selective ion trap such as a 3D quadrupole ion trap. A first bunch of ions having mass to charge ratios within a first range are released at a time $t_1$ and then after a delay time $\Delta t_1$ the electrode of the orthogonal acceleration Time of Flight mass analyser is energised so that the ions released from the ion trap are orthogonally accelerated into the drift region of the orthogonal acceleration Time of Flight mass analyser. Then a second bunch of ions having different mass to charge ratios are released from the ion trap and the electrode is energised after a second different delay time $\Delta t_2$. This process is preferably repeated multiple e.g. three, four, five, six, seven, eight, nine, ten or more than ten times until eventually ions having mass to charge ratios across the whole desired range are released from the ion trap. Advantageously, very few of the ions released from the ion trap are lost (i.e. are not orthogonally accelerated into the drift region), and hence the duty cycle is correspondingly very high across the whole mass range.

The second main embodiment differs from the first main embodiment in that multiple bunches of ions are released from the ion trap but the mass to charge ratios of the ions released and the timing of the release of the ions is such that substantially all of the ions released from the ion trap arrive at the pusher electrode at substantially the same time and are orthogonally accelerated into the drift region by a single energisation of the pusher/puller electrode. Ions may be released either in a stepped or a substantially continuous manner. Although the approach of the second main embodiment is different to that of the first main embodiment the effect is the same, namely that very few ions are lost and the duty cycle is correspondingly very high.

If the drift length from the exit of the mass selective ion trap upstream of the pusher electrode 1 to the centre of the pusher electrode 1 is L, then the distance L may be subdivided into two or more regions of lengths L1, L2 etc. and the ion drift energy in each region may be defined as V1, V2 etc. The flight time T1 for ions having a mass to charge of 1 is:

$$T1 = a\left(\frac{L1}{\sqrt{V1}} + \frac{L2}{\sqrt{V2}} + \ldots\right)$$

If T1 is in $\mu$s, L in meters and V in Volts then the constant "a" equals 72.

If the maximum mass to charge ratio of ions to be detected and recorded is $M_{max}$ then in order for all ions to arrive at the pusher electrode at the same time according to the second embodiment, the mass to charge ratio M of ions released from the ion trap should vary as a function of time T according to:

$$M = M_{\max} - 2 \cdot \sqrt{M_{\max}} \cdot \left(\frac{T}{T1}\right) + \left(\frac{T}{T1}\right)^2$$

If the distance L is divided into two regions, a first region L1 of length 80 mm wherein the ion drift energy V1 in this region is arranged to be 10 eV, and a second region L2 of length 90 mm wherein the ion drift energy V2 in this region is arranged to be 40 eV then T1, the flight time for ions having a mass to charge ratio equal to 1, will be 2.846 $\mu$s.

Figure 3:
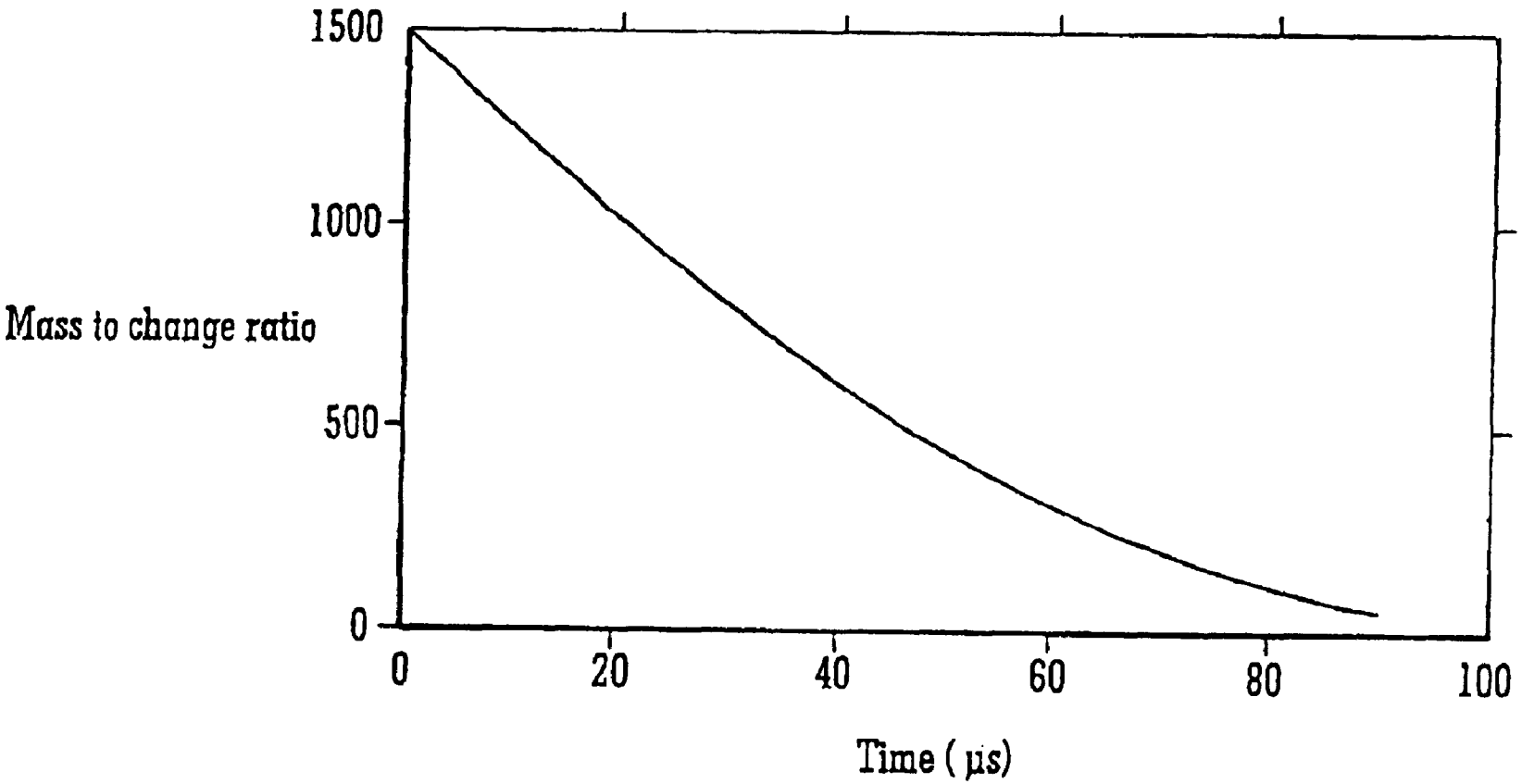
FIG. 3 shows the time at which ions having mass to charge ratios within the range 1–1500 need to be released from a mass selective ion trap in order that the ions reach the pusher electrode at substantially the same time according to the second main embodiment.

If $M_{max}$ equals 1500, then assuming that ions with mass to charge 1500 are released at time zero then ions having mass to charge ratios <1500 should be released from the ion trap at a subsequent time as shown in FIG. 3. As can be seen, ions of low mass to charge ratios should be released approximately 80–100 $\mu$s after ions of mass to charge ratio 1500. If this is achieved then substantially all of the ions released from the ion trap will arrive at the pusher electrode at substantially the same time, and hence the pusher electrode in a single energisation will orthogonally accelerate substantially all of the ions released from the ion trap. The ion trap may substantially continuously track a mass scan law similar to that shown in FIG. 3 or the ion trap may follow a mass release law which has a stepped profile.

Figure 4:
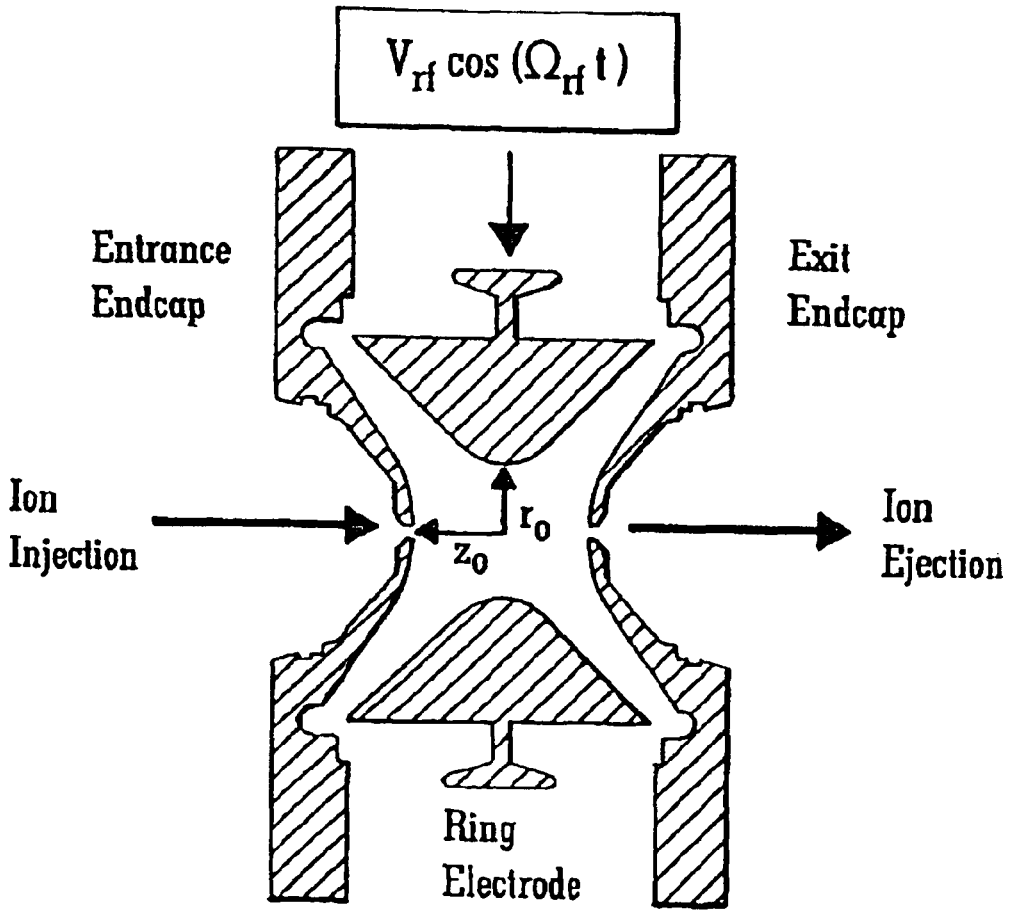
FIG. 4 PRIOR ART
FIG. 4 illustrates a known 3D quadrupole field ion trap.
Figure 5:
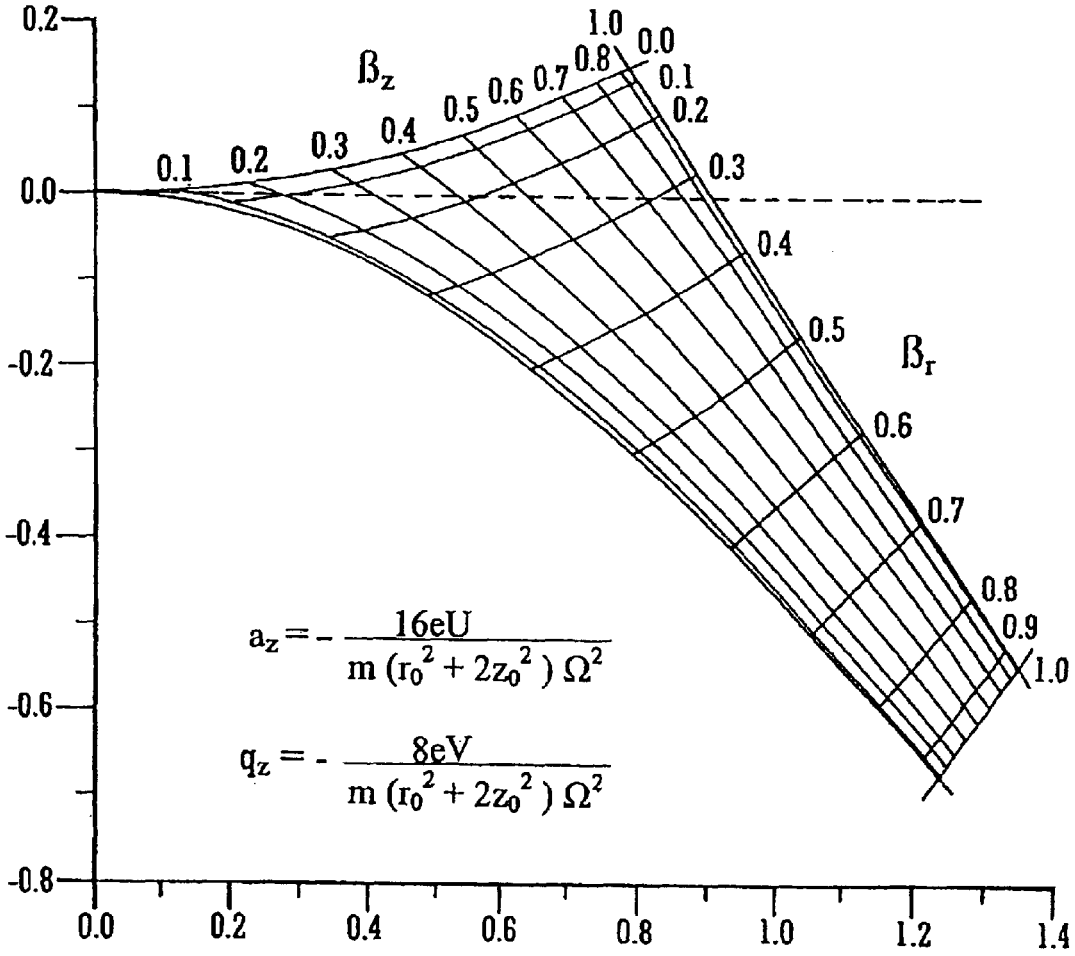
FIG. 5 PRIOR ART
FIG. 5 shows a stability diagram for the known 3D quadrupole field ion trap.

A 3D quadrupole field ion trap is shown in FIG. 4 and the stability diagram for the ion trap is shown in FIG. 5. There are numerous ways in which quadrupole field ion traps may be scanned or their mass selective characteristics otherwise set or varied so as to eject ions sequentially. Methods of ejecting ions from mass selective ion traps tend to fall into two categories.

A first approach is to use mass selective instability wherein the RF voltage and/or DC voltage may be scanned to sequentially move ions to regimes of unstable motion which results in the ions being no longer confined within the ion trap. Mass selective instability has either a highpass or a lowpass characteristic. It will be appreciated that the upper mass cut-off (for lowpass operation) or the lower mass cut-off (for highpass operation) can be progressively varied if desired.

A second approach is to use resonance ejection wherein an ancillary AC voltage (or "tickle" voltage) may be applied so as to resonantly excite and eventually eject ions of a specific mass to charge ratio. The RF voltage or AC frequency may be scanned or otherwise varied so as to sequentially eject ions of different mass to charge ratios.

Resonance ejection allows ions of certain mass to charge ratios to be ejected whilst retaining ions with higher and lower mass to charge ratios. An ancillary AC voltage with a frequency equal to the frequency of axial secular motion of ions with the selected mass to charge ratios may be applied to the end caps of the 3D quadrupole field ion trap. The frequency of axial secular motion is $f/2\beta_z$, where f is the frequency of the RF voltage. These ions will then be resonantly ejected from the ion trap in the axial direction. The range of mass to charge values to be ejected can be increased by sweeping the RF voltage with a fixed AC frequency, or by sweeping the AC frequency at a fixed RF voltage Alternatively, a number of AC frequencies may be simultaneously applied to eject ions with a range of mass to charge values.

In order to release ions in reverse order of mass to charge ratio according to the second main embodiment it is required to scan down in mass to charge ratio relatively quickly. In order to release ions in the axial direction in reverse order using mass selective instability it is necessary to scan such that ions sequentially cross the $\beta_z$=0 boundary of the stability regime. This can be achieved by progressively applying a reverse DC voltage between the centre ring and the end caps or by scanning both this DC voltage and the RF voltage.

Alternatively, a small DC dipole may be applied between the end caps so that ions with the smallest $\beta_z$ values are displaced towards the negative cap. As this voltage is increased ions having high mass to charge ratios will initially be ejected followed by ions having relatively low mass to charge ratios. This method has the advantage of ejecting ions in one axial direction only.

The mass scan law of the mass selective ion trap and the timing of the pusher electrode in relation to the release of ions from the ion trap may preferably take into account the effects of any time lag between arriving at conditions for ejection of ions of a particular mass to charge ratio and the actual ejection of those ions. Such a time lag may be of the order of several tens of $\mu$s. Preferably, this lag is taken into account when setting the delay time between scanning the ion trap and applying the pusher pulse to the orthogonal acceleration Time of Flight mass analyser. The scan law of the applied voltages may also be adjusted to correct for this time lag and to ensure that ions exit the trap according to the required scan law.

Resonance ejection may also be used to eject ions in reverse order of mass to charge ratio according to the second main embodiment. However, resonance ejection is less preferred in view of the time required to resonantly eject ions, and the limited time available in which to scan the ion trap. A full scan is preferably required in less than 1 ms.

It is contemplated that a combination of mass selective instability and resonance ejection may be used in order to eject ions from the 3D ion trap according to both main embodiments.

Ions may potentially be ejected from the ion trap with quite high energies e.g. many tens of electron-volts or more depending on the method of scanning. The ion energies may also vary with mass depending upon the method of scanning. Since it is desired that all the ions arrive at the orthogonal acceleration region with approximately the same ion energies, the DC potential of the ion trap may preferably be scanned in synchronism with the ions leaving the ion trap. The correction to ion energy could be made at any position between the ion trap and the pusher electrode. However, it is preferable that the correction is made at the point where the ions leave the ion trap and before the drift region so that the required mass scan law will remain similar to that in the example given above.

After each scan the mass selective ion trap may be empty of ions. The ion trap can be refilled with ions from a further upstream ion trap as explained above. The ion trap may then repeat the cycle and sequentially eject the ions according to above scan law.

The pusher voltage is preferably applied to the pusher electrode 1 of the orthogonal acceleration Time of Flight mass spectrometer in synchronism with the scanning of the ion trap and with the required time delay having preferably taken into account any time lag effects.

A further embodiment is contemplated which combines the first and second embodiments. For example, the ion trap could be scanned in reverse order of mass over a selected range of masses according to the second embodiment followed by scanning over another selected range of masses according to the first embodiment in the following cycle or vice versa.

Although a further ion trap may be provided upstream of the mass selective ion trap, the provision of a further ion trap is optional. For example, operation with a pulsed ion source such as laser ablation or Matrix Assisted Laser Desorption Ionisation ("MALDI") ion source would not necessarily require two ion traps in order to maximise the duty cycle. The process of mass selective release of ions and sampling with an orthogonal acceleration Time of Flight mass analyser could be completed within the time period between pulses. Accordingly, all the ions over the full mass range of interest could be mass analysed prior to the ion source being reenergised and hence it would not be necessary to store ions from the source in a further ion trap.

In order to illustrate this further it may be assumed for sake of illustration only that the mass to charge ratio range of interest is from 400–3500. Ions having mass to charge ratios falling within a specific range may be ejected from the ion trap and accelerated to an energy of 40 eV before travelling a distance of 10 cm to the centre of the orthogonal acceleration region of the orthogonal acceleration Time of Flight mass analyser. It is assumed that the ejected ions have an energy spread of ±4 eV about a mean energy of 40 eV. Furthermore, it may be assumed the length of the orthogonal acceleration region is 3 cm such that the range of path lengths is ±1.5 cm about a mean 10 cm path length for acceptance of ions into the orthogonal acceleration Time of Flight mass analyser. Finally, it is assumed that the ions within the selected range of mass to charge ratios are ejected over a period of 2 μs. It will be seen from the calculations below that the full mass range of interest can be covered in a sequence of just eight mass selective ejections summarised in the table below.

For each stage in the sequence the delay time between ion ejection and the orthogonal acceleration pulse is given. It is assumed that the distance between the centre of the orthogonal acceleration region and the ion detector is 10 cm which equals that between the ion trap and the orthogonal acceleration region. The Time of Flight time will therefore be equal to the delay time. Finally, it has been assumed that the time for ion ejection from the ion trap is 20 μs and the overhead time required for data handling, programming of electronic power supplies, etc. between each stage in the sequence is 250 μs.

| Ion ejection time (μsec) | Delay time (μsec) | Lowest mass for full trans-mission | Highest mass for full trans-mission | TOF flight time (μsec) | Overhead time (μsec) | Total time (μsec) |
|---|---|---|---|---|---|---|
| 20 | 24 | 402 | 508 | 24 | 250 | 318 |
| 20 | 27 | 504 | 649 | 27 | 250 | 324 |
| 20 | 30.5 | 637 | 836 | 30.5 | 250 | 331 |
| 20 | 35 | 832 | 1111 | 35 | 250 | 340 |
| 20 | 40 | 1079 | 1461 | 40 | 250 | 350 |
| 20 | 46.5 | 1449 | 1989 | 46.5 | 250 | 363 |
| 20 | 54 | 1942 | 2699 | 54 | 250 | 378 |
| 20 | 63 | 2629 | 3694 | 63 | 250 | 396 |

In this example it can be seen that the overall time required for the full sequence of eight stages of ion ejection is only 2.8 ms. For MALDI the laser repetition rate is currently typically 20 Hz. Hence, the time between laser shots is 50 ms and so the complete sequence of eight mass selective ejection stages can easily be fitted into the time between laser pulses.

It is likely that as advances are made the laser repetition rate for MALDI may increase to e.g. 100 or 200 Hz. However, even at 200 Hz the time between laser shots will only be 5 ms which still allows sufficient time for the sequence of eight mass selective ejection stages. Hence, for pulsed ion sources such as MALDI, the ion sampling duty cycle for the orthogonal acceleration Time of Flight mass analyser can be increased to approximately 100% with the use of just a single mass selective ion trap.

Although the present invention has been described with reference to preferred embodiments and other arrangements, it will be understood by those skilled in the art that various changes in form and detail may be made without departing from the scope of the invention as set forth in the accompanying claims.

What is claimed is:

1. A mass spectrometer comprising:

a mass selective ion trap;

an orthogonal acceleration Time of Flight mass analyser arranged downstream of the ion trap, said orthogonal acceleration Time of Flight mass analyser comprising an electrode for orthogonally accelerating ions; and a control means for controlling said mass selective ion trap and said orthogonal acceleration Time of Flight mass analyser, wherein in a mode of operation said control means controls said ion trap and said orthogonal acceleration Time of Flight mass analyser so that:

(i) at a first time $t_1$ ions having mass to charge ratios within a first range are arranged to be substantially passed from said ion trap to said orthogonal acceleration Time of Flight mass analyser whilst ions having mass to charge ratios outside of said first range are not substantially passed to said orthogonal acceleration Time of Flight mass analyser and are substantially retained within said ion trap;

(ii) at a later time $t_1+\Delta t_t$ the electrode is arranged to orthogonally accelerate ions having mass to charge ratios within said first range;

(iii) at a second later time $t_2$ ions having mass to charge ratios within a second range are arranged to be substantially passed from said ion trap to said orthogonal acceleration Time of Flight mass analyser whilst ions having mass to charge ratios outside of said second range are not substantially passed to said orthogonal acceleration Time of Flight mass analyser and are substantially retained within said ion trap; and (iv) at a later time $t_2+\Delta t_2$ said electrode is arranged to orthogonally accelerate ions having mass to charge ratios within said second range, wherein $\Delta t_1 \neq \Delta t_2$.

2. A mass spectrometer as claimed in claim 1, wherein said first range has a minimum mass to charge ratio $M1_{min}$ and a maximum mass to charge ratio $M1_{max}$ and wherein the value $M1_{max}-M1_{min}$ falls within a range selected from the group consisting of: (i) 1–50; (ii) 50–100; (iii) 100–200; (iv) 200–300; (v) 300–400; (vi) 400–500; (vii) 500–600; (viii) 600–700; (ix) 700–800; (x) 800–900; (xi) 900–1000; (xii) 1000–1100; (xiii) 1100–1200; (xiv) 1200–1300; (xv) 1300–1400; (xvi) 1400–1500; and (xvii)>1500.

3. A mass spectrometer as claimed in claim 1, wherein said second range has a minimum mass to charge ratio $M2_{min}$ and a maximum mass to charge ratio $M2_{max}$ and wherein the value $M2_{max}-M2_{min}$ falls within a range selected from the group consisting of: (i) 1–50; (ii) 50–100; (iii) 100–200; (iv) 200–300; (v) 300–400; (vi) 400–500; (vii) 500–600; (viii) 600–700; (ix) 700–800; (x) 800–900; (xi) 900–1000; (xii) 1000–1100; (xiii) 1100–1200; (xiv) 1200–1300; (xv) 1300–1400; (xvi) 1400–1500; and (xvii) >1500.

4. A mass spectrometer as claimed in claim 1, wherein said control means further controls said ion trap and said orthogonal acceleration Time of Flight mass analyser so that:

(v) at a third later time $t_3$ ions having mass to charge ratios within a third range are arranged to be substantially passed from said ion trap to said orthogonal acceleration Time of Flight mass analyser whilst ions having mass to charge ratios outside of said third range are not substantially passed to said orthogonal acceleration Time of Flight mass analyser; and (vi) at a later time $t_3+\Delta t_3$ said electrode is arranged to orthogonally accelerate ions having mass to charge ratios within said third range, wherein $\Delta t_1 \neq \Delta t_2 \neq \Delta t_3$.

5. A mass spectrometer as claimed in claim 4, wherein at said third time $t_3$ ions having mass to charge ratios outside of said third range are substantially retained within said ion trap.

6. A mass spectrometer as claimed in claim 4, wherein said third range has a minimum mass to charge ratio $M3_{min}$ and a maximum mass to charge ratio $M3_{max}$ and wherein the value $M3_{max}-M3_{min}$ falls within a range selected from the group consisting of: (i) 1–50; (ii) 50–100; (iii) 100–200; (iv) 200–300; (v) 300–400; (vi) 400–500; (vii) 500–600; (viii) 600–700; (ix) 700–800; (x) 800–900; (xi) 900–1000; (xii) 1000–1100; (xiii) 1100–1200; (xiv) 1200–1300; (xv) 1300–1400; (xvi) 1400–1500; and (xvii)>1500.

7. A mass spectrometer as claimed in claim 4, wherein said control means further controls said ion trap and said orthogonal acceleration Time of Flight mass analyser so that:

(vii) at a fourth later time $t_4$ ions having mass to charge ratios within a fourth range are arranged to be substantially passed from said ion trap to said orthogonal acceleration Time of Flight mass analyser whilst ions having mass to charge ratios outside of said fourth range are not substantially passed to said orthogonal acceleration Time of Flight mass analyser, and (viii) at a later time $t_4+\Delta t_4$ said electrode is arranged to orthogonally accelerate ions having mass to charge ratios within said fourth range, wherein $\Delta t_1 \neq \Delta t_2 \neq \Delta t_3 \neq \Delta t_4$.

8. A mass spectrometer as claimed in claim 7, wherein at said fourth time $t_4$ ions having mass to charge ratios outside of said fourth range are substantially retained within said ion trap.

9. A mass spectrometer as claimed in claim 7, wherein said fourth range has a minimum mass to charge ratio $M4_{min}$ and a maximum mass to charge ratio $M4_{max}$ and wherein the value $M4_{max}-M4_{min}$ falls within a range selected from the group consisting of: (i) 1–50; (ii) 50–100; (iii) 100–200; (iv) 200–300; (v) 300–400; (vi) 400–500; (vii) 500–600; (viii) 600–700; (ix) 700–800; (x) 800–900; (xi) 900–1000; (xii) 1000–1100; (xiii) 1100–1200; (xiv) 1200–1300; (xv) 1300–1400; (xvi) 1400–1500; and (xvii)>1500.

10. A mass spectrometer as claimed in claim 1, wherein said ion trap is selected from the group consisting of: (i) a 3-D quadrupole ion trap; (ii) a magnetic ("Penning") ion trap; and (iii) a linear quadrupole ion trap.

11. A mass spectrometer as claimed in claim 1, wherein said ion trap comprises in use a gas and ions are arranged to either: (i) enter said ion trap with energies such that said ions are collisionally cooled without substantially fragmenting upon colliding with said gas; or (ii) enter said ion trap with energies such that at least 10% of said ions are caused to fragment upon colliding with said gas.

12. A mass spectrometer as claimed in claim 1, wherein ions are released from said ion trap by mass-selective instability.

13. A mass spectrometer as claimed in claim 12, wherein $M1_{max}$ and/or $M2_{max}$ and/or $M3_{min}$ and/or $M4_{min}$ are at infinity.

14. A mass spectrometer as claimed in claim 12, wherein $M1_{min}$ and/or $M2_{min}$ and/or $M3_{min}$ and/or $M4_{min}$ are zero.

15. A mass spectrometer as claimed in claim 1, wherein ions are released from said ion trap by resonance ejection.

16. A mass spectrometer as claimed in claim 1, wherein said orthogonal acceleration Time of Flight mass analyser comprises a drift region and an ion detector, wherein said electrode is arranged to orthogonally accelerate ions into said drift region.

17. A mass spectrometer as claimed in claim 1, further comprising:

an ion source;

a quadrupole mass filter; and a gas collision cell for collision induced fragmentation of ions.

18. A mass spectrometer as claimed in claim 1, further comprising a continuous ion source.

19. A mass spectrometer as claimed in claim 18, wherein said continuous ion source is selected from the group consisting of: (i) an Electrospray ion source; (ii) an Atmospheric Pressure Chemical Ionisation ("APCI") ion source; (iii) an Electron Impact ("EI") ion source; (iv) an Atmospheric Pressure Photon Ionisation ("APPI") ion source; (v) a Chemical Iomsation ("CI") ion source; (vi) a Fast Atom Bombardment ("FAB") ion source; (vii) a Liquid Secondary Ions Mass Spectrometry ("LSIMS") ion source; (viii) an Inductively Coupled Plasma ("ICP") ion source; (ix) a Field Ionisation ("FI") ion source; (x) a Field Desorption ("FD") ion source.

20. A mass spectrometer as claimed in claim 1, further comprising a pseudo-continuous ion source.

21. A mass spectrometer as claimed in claim 20, wherein said pseudo-continuous ion source comprises a Matrix Assisted Laser Desorption Ionisation ("MALDI") ion source and a drift tube or drift region arranged so that ions become dispersed.

22. A mass spectrometer as claimed in claim 21, wherein a gas is arranged in said drift tube or drift region to collisionally cool said ions.

23. A mass spectrometer as claimed in claim 1, further comprising a pulsed ion source.

24. A mass spectrometer as claimed in claim 23, wherein said pulsed ion source is selected from the group consisting of: (i) a Matrix Assisted Laser Desorption Ionisation ("MALDI") ion source; and (ii) a Laser Desorption Ionisation ("LDI") ion source.

25. A mass spectrometer as claimed in claim 1, further comprising a further ion trap upstream of said ion trap.

26. A mass spectrometer as claimed in claim 25, wherein in a mode of operation the axial electric field along said further ion trap is varied.

27. A mass spectrometer as claimed in claim 26, wherein said axial electric field is varied temporally and/or spatially.

28. A mass spectrometer as claimed in claim 25, wherein in a mode of operation ions are urged along said further ion trap by an axial electric field which varies along the length of said further ion trap.

29. A mass spectrometer as claimed in claim 25, wherein in a mode of operation at least a portion of said further ion trap acts as an AC or RF-only ion guide with a constant axial electric field.

30. A mass spectrometer as claimed in claim 25, wherein in a mode of operation at least a portion of said further ion trap retains or stores ions within one or more locations along the length of said further ion trap.

31. A mass spectrometer as claimed in claim 25, wherein said further ion trap comprises an AC or RF ion tunnel ion trap comprising at least 4 electrodes having similar sized apertures through which ions are transmitted in use.

32. A mass spectrometer as claimed in claim 25, wherein said further ion trap is selected from the group consisting of: (i) a linear quadrupole ion trap; (ii) a linear hexapole, octopole or higher order multipole ion trap; (iii) a 3D quadrupole ion trap; and (iv) a magnetic ("Penning") ion trap.

33. A mass spectrometer as claimed in claim 25, wherein said further ion trap substantially continuously receives ions at one end.

34. A mass spectrometer as claimed in claim 25, wherein said further ion trap comprises in use a gas and ions are arranged to either: (i) enter said further ion trap with energies such that said ions are collisionally cooled without substantially fragmenting upon colliding with said gas; or (ii) enter said further ion trap with energies such that at least 10% of said ions are caused to fragment upon colliding with said gas.

35. A mass spectrometer as claimed in claim 25, wherein said further ion trap periodically releases ions and passes at least some of said ions to said ion trap.

36. A mass spectrometer comprising:

a linear or 3D quadrupole ion trap;

an orthogonal acceleration Time of Flight mass analyser arranged downstream of said quadrupole ion trap, said orthogonal acceleration Time of Flight mass analyser comprising an electrode for orthogonally accelerating ions; and control means for controlling said ion trap and said electrode, wherein said control means causes:

(i) a first packet of ions having mass to charge ratios within a first range to be released from said ion trap whilst ions having mass to charge ratios outside of said first range are substantially retained within said ion trap and then said electrode to orthogonally accelerate said first packet of ions after a first delay time; and (ii) a second packet of ions having mass to charge ratios within a second range to be released from said ion trap whilst ions having mass to charge ratios outside of said second range are substantially retained within said ion trap and then said electrode to orthogonally accelerate said second packet of ions after a second different delay time.

37. A mass spectrometer as claimed in claim 36, wherein said control means further causes:

(iii) a third packet of ions having mass to charge ratios within a third range to be released from said ion trap and then said electrode to orthogonally accelerate said third packet of ions after a third delay time; and (iv) a fourth packet of ions having mass to charge ratios within a fourth range to be released from said ion trap and then said electrode to orthogonally accelerate said fourth packet of ions after a fourth delay time.

38. A mass spectrometer as claimed in claim 37, wherein said first, second, third and fourth ranges are all different.

39. A mass spectrometer as claimed claim 37, wherein said first, second, third and fourth delay times are all different.

40. A method of mass spectrometry comprising:

ejecting ions having mass to charge ratios within a first range from a mass selective ion trap whilst ions having mass to charge ratios outside of said first range are retained within said ion trap;

orthogonally accelerating ions having mass to charge ratios within said first range after a first delay time;

ejecting ions having mass to charge ratios within a second range from a mass selective ion trap whilst ions having mass to charge ratios outside of said second range are retained within said ion trap; and orthogonally accelerating ions having mass to charge ratios within said second range after a second delay time different from said first delay time.

41. A mass spectrometer comprising a mass selective ion trap upstream of an electrode for orthogonally accelerating ions, wherein in a mode of operation a first packet of the ions is released from said ion trap and said electrode is energised after a first predetermined delay time, a second packet of the ions is released from said ion trap and said electrode is energised after a second predetermined delay time, a third packet of the ions is released from said ion trap and said electrode is energised after a third predetermined delay time, and a fourth packet of the ions is released from said ion trap and said electrode is energised after a fourth predetermined delay time, wherein said first, second, third and fourth delay times are all different.

42. A mass spectrometer comprising:

a mass selective ion trap; and an orthogonal acceleration Time of Flight mass analyser having an electrode for orthogonally accelerating ions into a drift region;

wherein multiple packets of ions are progressively released from said mass selective ion trap and are sequentially or serially ejected into said drift region after different delay times whilst residual ions are substantially retained within said ion trap.

43. A method of mass spectrometry comprising:

progressively releasing multiple packets of ions from a mass selective ion trap so that said packets of ions are sequentially or serially ejected into a drift region of an orthogonal acceleration Time of Flight mass analyser by an electrode after different delay times whilst residual ions are substantially retained within said ion trap.

* * * * *